US005816364A

United States Patent [19]

Christy et al.

[11] Patent Number: 5,816,364

[45] Date of Patent: Oct. 6, 1998

[54] LADDER LEVELING APPARATUS

[76] Inventors: Cynthia Christy; Mark Christy, both of 1708 Thompson St., Emporia, Kans. 66801

[21] Appl. No.: 892,866

[22] Filed: Jul. 14, 1997

[51] Int. Cl.[6] ..... E06C 7/44

[52] U.S. Cl. ..... 182/201

[58] Field of Search ..... 182/200–205

[56] References Cited

U.S. PATENT DOCUMENTS

| | | | |
|---|---|---|---|
| 1,033,685 | 7/1912 | Eskew | 182/205 |
| 1,560,978 | 11/1925 | Crump | 182/204 |
| 2,331,629 | 10/1943 | Reilly | 182/201 |
| 2,350,116 | 5/1944 | Kimes | 182/201 |
| 4,744,441 | 5/1988 | Sandstrom | 182/111 |
| 4,995,474 | 2/1991 | Gauthier | 182/201 |
| 5,148,892 | 9/1992 | Lu | 182/201 |
| 5,464,071 | 11/1995 | Rice et al. | 182/205 |

FOREIGN PATENT DOCUMENTS

| | | | |
|---|---|---|---|
| 2665924 | 2/1992 | France | 182/201 |
| 516447 | 2/1995 | Italy | 182/205 |
| 10852 | 5/1910 | United Kingdom | 182/201 |
| 901224 | 7/1962 | United Kingdom | 182/205 |
| 1358701 | 7/1974 | United Kingdom | 182/201 |

*Primary Examiner*—Alvin C. Chin-Shue
*Attorney, Agent, or Firm*—Henderson & Sturm

[57] ABSTRACT

A ladder leveling apparatus 10 including a ladder member 20 having ladder legs 21 that are received in a ladder leg adapter unit 12 including boot members 30 wherein the position of the bottom of the ladder legs 21 relative to the boot members 30 are controlled by elongated adjustment rod members 40 having an enlarged head member 44 which is actuated proximate the upper portion of the ladder member 20.

1 Claim, 1 Drawing Sheet

LADDER LEVELING APPARATUS

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of ladder leveling devices in general, and in particular to a ladder leveling apparatus that allows the user to level the ladder from an elevated location.

2. Description of Related Art

As can be seen by reference to the following U.S. Pat. Nos. 4,744,441; 4,995,474; 5,148,892; and 5,464,071, the prior art is replete with myriad and diverse ladder leg leveling apparatus.

While all of the aforementioned prior art constructions are more than adequate for the basic purpose and function for which they have been specifically designed, they are uniformly deficient with respect to their failure to provide a simple, efficient, and practical way of leveling a ladder from an elevated working height.

Unfortunately, with all of the known ladder leveling systems, the user would make an initial adjustment at ground level then climb the ladder to determine if the adjustment was correct, then climb back down the ladder to refine the adjustment, etc.

As a consequence of the foregoing situation, there has existed a longstanding need for a new and improved ladder leveling apparatus which allows the user to adjust each of the legs of a ladder in an independent fashion from an elevated height on the ladder and the provision of such a construction is a stated objective of the present invention.

BRIEF SUMMARY OF THE INVENTION

Briefly stated, the ladder adjustment apparatus that forms the basis of the present invention comprises a plurality of boot units that are dimensioned to slideably engage the legs of a ladder member and an actuator unit associated with each of the legs of the ladder member for varying the position of the boot units relative to the bottom of the ladder legs.

As will be explained in greater detail further on in the specification, the actuator unit comprises a plurality of elongated actuator members wherein each of the ladder legs and each of the boot units are provided with bracket members which are operatively associated with the individual actuator members.

In addition, the ladder member is provided with a bubble level on one of the upper steps of the ladder member and the upper end of the actuator members are disposed at a height proximate the height of the bubble level such that the user can engage the actuator members while standing on the ladder member. the leveling of the ladder member will occur proximate the step height that the user's feet will occupy when employing the ladder for its intended purpose.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
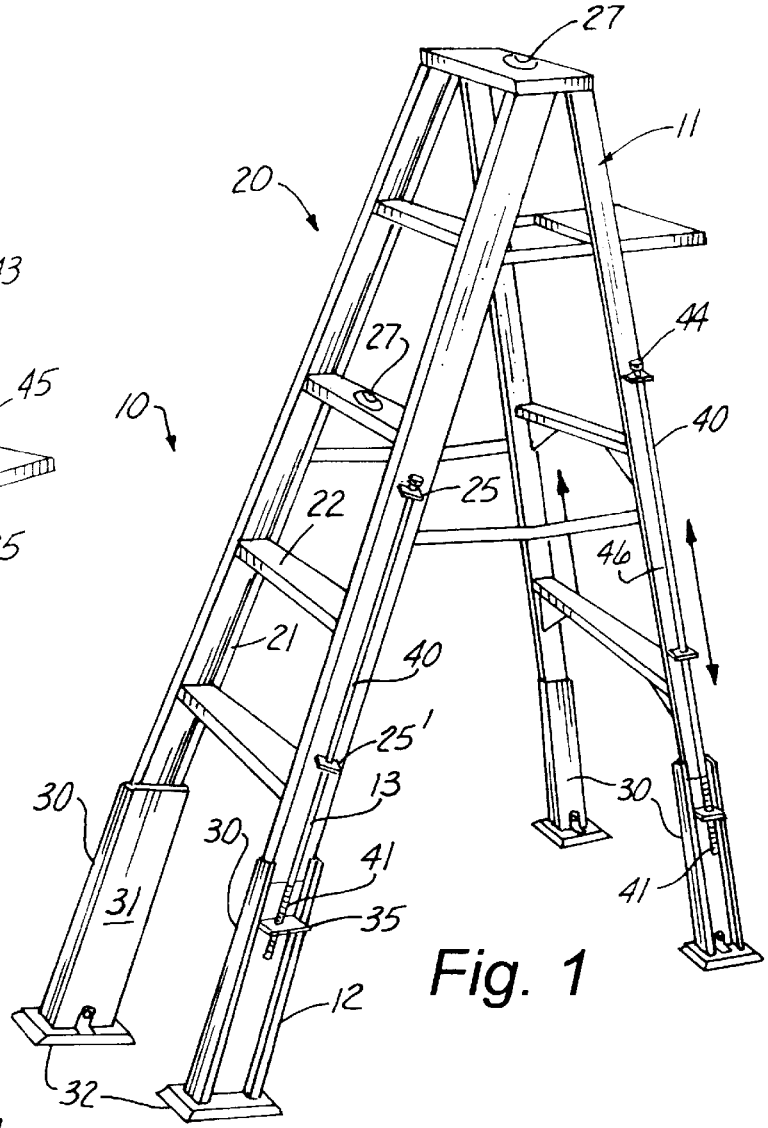
FIG. 1 is a perspective view of the ladder leveling apparatus that forms the basis of the present invention.

As can be seen by reference to the drawings, and in particularly to FIG. 1, the ladder leveling apparatus that forms the basis of the present invention is designated generally by the reference number 10. The apparatus 10 comprises in general a ladder unit 11, a ladder foot adapter unit 12, and an adjustment unit 13. These units will now be described in seriatim fashion.

As can best be seen by reference to FIG. 1, the ladder unit 11 comprises a ladder member 20 having at least a pair of ladder legs 21 connected together by a plurality of ladder steps 22 in a well recognized fashion.

In addition, each of the ladder legs 21 are provided with a pair of outwardly projecting widely spaced support brackets 25, 25', and at least one of the upper steps 22 of the ladder member 20 is provided with a bubble level 27. The purpose and function of the support brackets 25, 25', and the bubble level 27 will be described presently.

Still referring to FIG. 1, it can be seen that the ladder leg adapter unit 12 comprises a plurality of boot members 30 having an upper portion 31 dimensioned to slideably receive the lower portion of the ladder legs 21 and a lower enlarged foot element 32 which serves as the base of the boot members 30. Furthermore, each of the boot members 30 are provided with an outwardly projecting apertured support bracket 35 whose purpose and function will be described presently.

As can also best be seen by reference to FIG. 1, the adjustment unit 13 comprises an elongated adjustment rod member 40 having a threaded lower end 41 and an enlarged contoured upper end 42.

Figure 2:
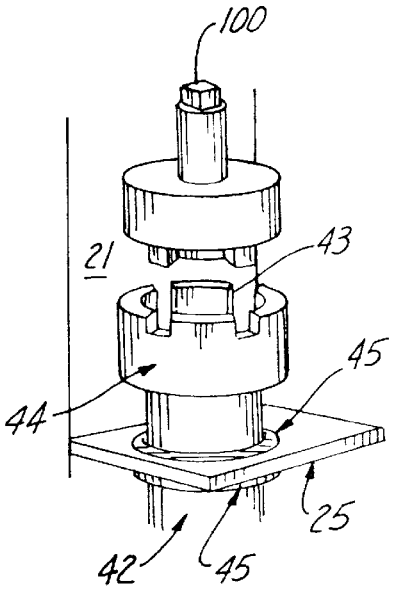
FIG. 2 is an isolated detail view of the upper end of the adjustment unit.

Turning now to FIG. 2, it can be seen that the upper end 42 of the adjustment rod member 40 has a recessed keyway 43 formed in an enlarged head member 44 which is dimensioned to receive a bit 100 from a conventional power tool (not shown) for imparting rotary motion to the adjustment rod member 40.

In addition, the upper end 42 of the adjustment rod member 40 is dimensioned to be rotatably received in the upper support bracket 25 of the ladder leg 21 and captively engaged with respect thereto by virtue of a pair of collar elements 45 formed on the upper end 42 of the adjustment rod member 40.

Furthermore, as shown in FIG. 1, the intermediate portion 46 of the adjustment rod member 40 is also dimensioned to be rotatably received in the lower support bracket 25' to provide lateral support to the adjustment rod member 40.

It should also be noted at this juncture that the ladder member 20 as shown in FIG. 1 is further provided with one or more bubble levels 27 which are disposed on the upper steps 22 of the ladder member 20 such that the user may manipulate the ladder leveling apparatus 10 from an elevated height without the need to climb back down the ladder to make each incremental adjustment.

This feature is particularly significant in those instances wherein the ladder member 20 is deployed on soft ground and the weight of the user on the ladder member 20 over a period of time will cause an uneven settling of the boot members 30, whereby the user can effect the adjustment of the ladder member 20 relative to the boot members 30 from the users work location.

In closing, it should also be noted that while only a stepladder has been depicted in the drawings, this invention is equally suited to an extension style ladder as well, in keeping with the teachings contained herein.

Figure 3:
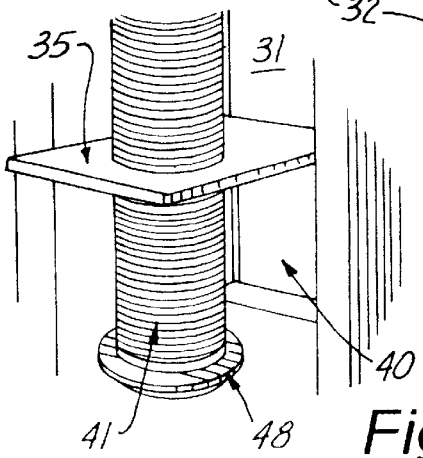
FIG. 3 is an isolated detail view of the lower end of the adjustment unit.

As can best be seen by reference to FIG. 3, the threaded lower end 41 of the adjustment rod member 40 is dimensioned to be threadably received in the support bracket 35 in the boot members 30, wherein the rotation of the adjustment rod member 40 will raise and lower the bottom of the legs 21 of the ladder member 20 relative to the boot members 30 in a well recognized fashion. In addition, the bottom of the adjustment rod member 40 is provided with a stop element 48 to limit the vertical movement of the adjustment rod member 40 relative to the support bracket 35.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

We claim:

1. The A ladder leveling apparatus for use with a ladder member having a pair of ladder legs each having an upper end, an intermediate portion, and a lower end connected together by a plurality of ladder steps comprising:

a ladder foot adapter unit comprising boot members dimensioned to slidably receive the lower end of the ladder legs; and an adjustment unit comprising a plurality of elongated adjustment rod members wherein each rod member has a threaded lower end, an upper end provided with an enlarged head, and an intermediate portion; wherein, the upper end of each of the adjustment rod members is operatively connected to the upper end of each of the ladder legs, the lower end of each of the adjustment rod members is operatively connected to a portion of one of the boot members for varying the location of the lower end of each ladder leg relative to their respective boot member and the intermediate portion of each of the adjustment rod members is connected to the intermediate portion of each of the ladder leg members; and at least one bubble level operatively associated with one of the upper steps of the ladder member proximate the upper end of the adjustment rod member wherein each boot member has a lower enlarged foot element and an upper portion dimensioned to slidably receive the ladder leg, the upper portion of the boot member is provided with an outwardly projecting bracket which is dimensioned to threadably receive the lower end of the adjustment rod member, the upper end of each ladder leg is provided with an outwardly projecting bracket member that is dimensioned to rotatably receive the upper end of the adjustment rod member, the intermediate portion of each ladder leg is further provided with another outwardly projecting bracket member which is dimensioned to rotatably receive the intermediate portion of the adjustment rod member, and the enlarged head member is contoured to form a keyway dimensioned to receive a power tool bit whereby the user can adjust the position of the lower end of each ladder leg relative to each boot member from the upper end of the ladder member.

* * * * *